United States Patent [19]

Linnell, II et al.

[11] Patent Number: 4,488,623

[45] Date of Patent: Dec. 18, 1984

[54] CANOE TRAVEL BOX

[76] Inventors: William S. Linnell, II, 25 Clinton St., South Portland, Me. 04106; Merle F. Libby, R.F.D. #3, Box 74, Caribou, Me. 04736

[21] Appl. No.: 539,541

[22] Filed: Oct. 6, 1983

[51] Int. Cl.[3] ..... A45F 3/00

[52] U.S. Cl. ..... 190/12 A; 190/12 R; 190/40; 190/115; 190/117; 312/282

[58] Field of Search ..... 190/12 A, 12 R, 11, 190/39, 40, 115, 117, 118, 119, 125; 312/282, 314, 315, 316; 206/541, 545; 108/33

[56] References Cited

U.S. PATENT DOCUMENTS

| | | | |
|---|---|---|---|
| 617,713 | 1/1899 | Brackett | 190/12 R |
| 1,371,987 | 3/1921 | Tanquery | 190/12 R |
| 1,520,879 | 12/1924 | Milne | 190/12 R |
| 1,616,814 | 2/1927 | Loreny | 190/40 |
| 2,366,069 | 12/1944 | Stein | 190/117 |
| 2,662,989 | 12/1953 | Thatcher . | |
| 2,939,756 | 6/1960 | Butcher . | |
| 3,653,474 | 4/1972 | Sadow | 190/115 |
| 4,163,484 | 8/1979 | Delaney | 190/115 |

*Primary Examiner*—Joseph Man-Fu Moy
*Assistant Examiner*—David T. Fidei
*Attorney, Agent, or Firm*—Daniel H. Kane, Jr.

[57] ABSTRACT

An elongate box with hinged cover is described particularly designed for canoe camping and travel. The box panels are reinforced at adjoining edges by square section posts defining flat spaces for receiving insulation panels flush with the respective box panels. A table panel for table use is secured to the undersurface of the box cover for storage during canoe travel. During table use, the table panel is secured by brackets to the side of the box. A multi-use coupling is formed adjacent one edge of the table panel for securing the table panel to the undersurface of the box cover and for coupling the top of a support leg to the table panel for weight bearing table use. Flexible loop handles are provided on the end of the box with quick disconnect couplings such as snap hooks for securing the handle loops over a thwart or other strut of a canoe during canoe travel. The box cover latch is also designed for quick release using a flexible thong for rapid access to the box during canoe travel.

10 Claims, 11 Drawing Figures

CANOE TRAVEL BOX

TECHNICAL FIELD

This invention relates to a new multipurpose travel and camping box for carrying food and equipment, with cooperating design features and elements particularly adapted for canoe travel. The invention provides in place of the traditional wanigan used in canoe journeys by people of the north woods, a canoe travel box of greater versatility and utility particularly suited to the rigors of river travel.

BACKGROUND ART

In the traditional mode of canoe travel by people of the north woods, food and equipment were carried in simple elongate boxes or packs known as wanigans. Such a wanigan is carried during a portage on the back of the canoeist using a long tump line fitted with a headband. The ends of the tump line are wrapped around respective ends of the wanigan and secured while the headband is fitted over the forehead of the portaging traveler. Such a traditional wanigan and tump line arrangement is of the utmost simplicity and not well adapted to the multiple requirements of the contemporary "sport" or recreationist.

A number of travel boxes and kits have been developed for the vacationing camper or traveler but none are particularly adapted for the rigors of canoe travel characterized by the constraints of limited space, frequent handling, rapid movement, quick access, and occasional immersion in the lotic environment.

The Butcher U.S. Pat. No. 2,939,756 describes an automobile travel kit box with assorted compartments and shelves but totally unsuited for accommodating the space requirements in a canoe, ready access within the canoe, and portaging. Similarly, Thatcher in U.S. Pat. No. 2,662,989 describes a combined portable table and cabinet with legs which is not well adapted to the necessities of water travel or rapid access within the confines of a canoe.

OBJECTS OF THE INVENTION

It is therefore an object of the present invention to provide a camping and travelling box particularly suited for the space limitations of canoe travel.

Another object of the invention is to provide a canoe travel box adapted to contain and protect the contents in the event of immersion in water. While securely storing its contents, the invention nevertheless contemplates rapid access to the box on water and on land.

A further object of the invention is to provide a canoe travel box suitable for compact portaging but which nevertheless provides multiple table surfaces and commodious storage during canoe camping.

DISCLOSURE OF THE INVENTION

In order to accomplish these results the present invention provides an elongate box formed of a pair of elongate rectangular side box panels, and elongate rectangular bottom box panel, and a pair of end box panels adjoining the elongate side box panels and bottom box panel. The box panels are secured at respective adjoining edges by vertical and horizontal square section posts inside the box lying along and abutting the adjoining edges of the box panels. The posts defined between adjacent parallel posts flat spaces coplanar with each of the respective box panels for receiving insulation panels flush with the box panels.

According to the invention a plurality of relatively rigid insulation panels comprised of waterproof flotation material are insertable between and frictionally engage the posts in at least some of the flat spaces flush with respective box panels. A feature and advantage of this arrangement is that the insulation panels provide an insulating enclosure for prolonged storage of food while at the same time providing flotation in the event of swamping or capsizing of the canoe.

A box cover is hinged to one of the side box panels for opening and closing through an arc of at least 180° with a cover latch for releasable closure engaging the other side box panel. A table panel for providing an extended table surface for table use adjacent to the box is secured to the undersurface of the box cover for storage. According to one embodiment, the table panel is formed with L brackets on one side. When positioned for table use, the L brackets engage slot brackets mounted on the upper edge of a side box panel so that the table panel is rigidly secured extending away from the box during table use. An optional supporting leg or auxiliary leg may also be provided for supporting the outer edge of the table panel projecting away from the box when weight is bearing on the table panel during table use. The auxiliary leg may be stored in the box and includes a coupling of the top for engaging the underside of the table panel.

During canoe travel the table panel is secured to the undersurface of the box cover so that access to the inside of the box may be readily achieved by simultaneously opening the box cover and secured table panel without interference from the table panel. According to a preferred example embodiment, the table panel is secured to the undersurface of the box cover at one side edge by retaining guides. The other side of the table panel is, for example, formed with a novel double slot keyhole for receiving a wing nut and bolt from the box cover and providing a bearing surface in one of the slots for the wing nut to secure the table panel against the box cover.

Loop handles are formed at each end of the box in the end box panels for carrying the canoe travel box. The flexible loop handles are formed with quick disconnect couplings, for example, in the form of snap hooks which may be centered at the end of each loop to provide hand grips for each handle. A feature and advantage of the flexible loop handle arrangement, according to the invention, is that they are formed with sufficient length for securing the handles over structures in the canoe such as, for example, a thwart. The handles thereby secure the box in the canoe during travel, for example through rapids, but may quickly opened for releasing the handle loops from the thwarts of the canoe.

In yet another feature of the invention, the complementary latch on the side of the box for engaging the cover latch includes a flexible thong which effectively secures the latch during canoe travel but permits flexible withdrawal and quick release of the thong for access to the box, for example, to retrieve a camera for photographs.

Other objects, features, and advantages of the invention will be apparent in the following specification and accompanying drawings.

DESCRIPTION OF PREFERRED EXAMPLE EMBODIMENTS AND BEST MODE OF THE INVENTION

Figure 1:
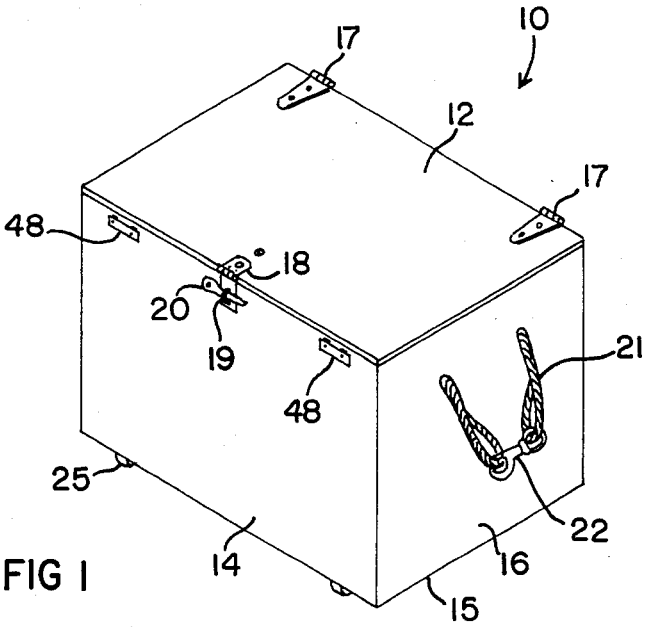
FIG. 1 is a perspective view of the canoe box with the box cover in closed position for canoe travel and showing one of the quick release side loop handles and the quick release cover latch.

A canoe travel box 10 according to the present invention is illustrated in FIG. 1 ready for placement in a canoe with the box cover 12 enclosed position. The elongate box 10 is generally constructed with a pair of elongate rectangular side box panels 14, an elongate rectangular bottom box panel 15, and a pair of end box panels 16 adjoining the elongate side box panels 14 and the bottom box panel 15. The box panels are secured at respective adjoining edges using vertical and horizontal square section posts inside the box and not visible in FIG. 1 but hereafter described with reference to FIG. 2. The elongate box cover 12 is hingedly connected to one of the side box panels 14 for opening and closing through an arc of at least 180°. In this case the hinges 17 permit the box cover 12 to swing open through a full arc until the box cover rests upon the ground for other object placed behind the box. The box cover 12 includes a cover latch 18 on the side opposite hinges 17 for releasable closure engaging a complementary latch 19 secured to side box panel 14.

Figure 1A:
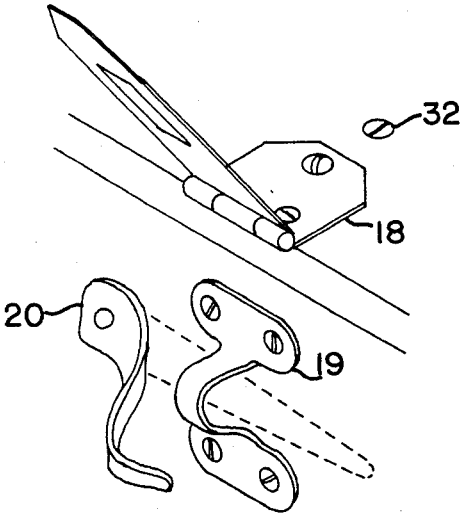
FIG. 1A is a detailed fragmentary view of the cover latch and complementary flexible thong with the thong in released position.

As shown in more detail in FIG. 1A, the complementary cover latch 19 includes a flexible thong 20 which is foldable and insertable through a loop in the latch for securing the complementary latch pieces 18 and 19. The flexible thong 20 may be formed, for example, by an elongate piece of heavy leather. A feature and advantage of the leather thong is that it may be easily folded and retracted for quickly releasing the complementary latch pieces 18 and 19 and for rapid access into the box during canoe travel to retrieve, for example, a camera to record a photograph in the midst of white water. On the other hand, the heavy leather thong when inserted through the complementary latch pieces provides secure closure of the box during rough travel and can be released only by purposeful manipulation pulling, folding and withdrawing the thong. The leather thong 20 is secured at one end to the side box panel 14 so that it cannot be lost and is readily accessible. While the leather thong 20 provides a flexible and readily releasable closure for the complementary latch elements 18 and 19, there is still room to attach a padlock, if desired, at the front of the box, for example, for shipping.

Figure 1B:
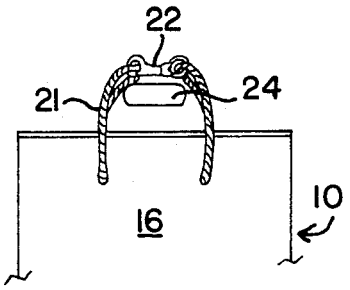
FIG. 1B is a detailed fragmentary view of a side loop handle over a canoe thwart.

As shown in FIGS. 1 and 1B, the box 10 is also provided with a paid of flexible loop handles 21 secured respectively to end box panel 16. The flexible loop handles may be, for example, rope handles secured through holes drilled in the end box panel 16 by forming knots in the ends of the rope inside the box. Each flexible loop handle is formed with a quick release fitting or shackle 22 such as a spring loaded snap hook of the type used for sailboat fittings. The snap hook or shackle 22 on each flexible loop rope handle 21 permits quick opening of each loop so that the loop handles 21 may be secured quickly over a canoe thwart 24 or other strut or structure in the canoe as shown in FIG. 1B after placement of the canoe box 10 in travel position in a canoe not shown. Additionally, the elongate snap hooks or shackles function as hand grips at the ends of the loop handles for carrying and portaging the box.

Figure 1C:
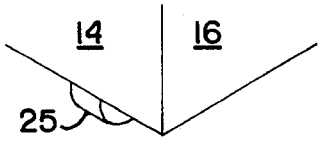
FIG. 1C is a detailed fragmentary perspective view of a bottom corner showing a rail or slide on the bottom box panel.

The bottom box panel 15 of the canoe travel box 10 is formed with at least two runners or slides 25 across the bottom as shown in the detail of FIG. 1C. Not only do the runners or slides 25 permit the box to be moved easily over hard surfaces, but also the runners 25 act as floor boards raising the bottom 15 of box 10 above the floor of the canoe and any water accumulated in the bottom of the canoe which might be taken in during running of rapids or navigation in rough waters.

Figure 2:
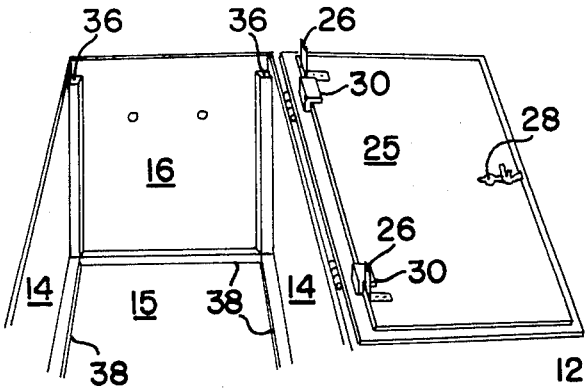
FIG. 2 is a plan view in partial perspective of the canoe box with the box cover in open position showing the table panel secured to the inside surface of the box cover for storage and also showing some square section posts adjoining the box panels.

The canoe travel box is shown in FIG. 2 with the box cover 12 in open position revealing the table panel 25 secured in storage position to the undersurface of box cover 12. The table panel is provided on one side with a pair of L brackets 26 for rigidly securing the table panel to a side of the box for table use as hereafter described, and also was formed with a double slotted keyhole 28 on the opposite side. The table panel 25 is secured to the undersurface of box cover 12 by a pair of guides or edge brackets 30 which provide overlapping edges or guides in which a side of the table panel 25 may be inserted and retained.

Figure 2A:
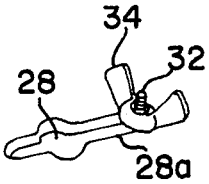
FIG. 2A is a detailed fragmentary view of the table panel double slotted keyhole and the box cover bolt and wing nut for securing the table panel to the box cover inside surface for storage during canoe travel.

As shown in more detail in FIG. 2A, the table panel 25 is secured to the undersurface of box cover 12 on the other side through the double slotted keyhole 28. For this purpose the undersurface of box cover 12 is provided with a projecting bolt 32 and wing nut 34 of a size which just passed through the double slotted keyhole 28 formed through table panel 25. Once table panel 25 and keyhole slot 28 are fitted over wing nut 34 on bolt 32, the table panel is seated fully in the guides 30 sliding the panel so that bolt 32 slides into the narrow slotted portion **28*a* of double slotted keyhole 28. Wing nut 34 can therefore be tightened and bear against table panel 25** securing it tightly in place against the undersurface of box cover 12. A feature and advantage of this arrangement for storage of table panel 25 during canoe travel is that rapid access may be had to the inside of the canoe travel box 10 by opening the box cover 12 after removal of the leather thong without interference by the table panel 25 while accessing the inside of the box.

FIG. 2 also shows on the inside of box 10 the construction according to the invention for joining the box panels at their respective adjoining edges. To this end vertical square section posts or braces 36 are provided at the adjoining edges of the side box panels and end box panels for securing the adjoining edges. The edges of the side box panels and end box panels may be respectively secured to the vertical posts or braces 36 by, for example brass screws, and waterproof glue along the adjoining surfaces for a water tight enclosure. Similarly, horizontal square section posts or braces 38 are provided at the adjoining edges of the bottom box panel and the side box panels and end box panels. The box panels are similarly secured to the horizontal braces 38 by, for example brass screws, with waterproof glue at adjoining surfaces to provide a waterproof enclosure around the base of the box.

Figure 2B:
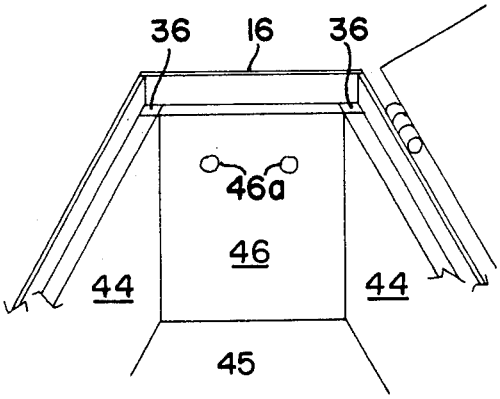
FIG. 2B is a detailed fragmentary perspective view of the canoe box with the box cover in open position showing some of the insulation panels in position between square section posts flush with the respective box panels.

A feature and advantage of this construction according to the invention as shown in more detail in FIG. 2B is that the square cross section posts or braces 36 and 38 define between adjacent parallel posts or braces flat spaces coplanar with each of the respective box panels for receiving insulation panels flush with the box panels. Thus, as shown in FIG. 2B, a bottom insulation panel 45 is frictionally fitted between the horizontal braces 38 flush against the bottom box panel 15 to provide an insulating layer across the base of the box. Similarly, end insulation panels 46 are frictionally fitted between vertical posts 36 flush with the end box panels 16 to provide an insulating layer at the ends of the box.

Similarly, side insulation panels not shown may be frictionally received between vertical posts or braces 36 flush with the side box panels 14 to complete the insulating enclosure around the sides and bottom of the box. Insulation panels, such as 45 and 46, also impart flotation to the canoe travel box in the event the canoe is swamped, for example, while poling or paddling through challenging white water. Furthermore, the canoe travel box with its own flotation can be readily separated from the canoe by opening the snap hooks 22 on the flexible loop handles 21 in the event they have been secured over a canoe thwart 24 as previously described with reference to FIGS. 1 and 1B. As shown in FIG. 2B, the end insulation panels 46 may be provided with circular cutouts **46*a* to accommodate the knotted ends of loop handles 21** secured in the box as heretofore described.

Figure 2C:
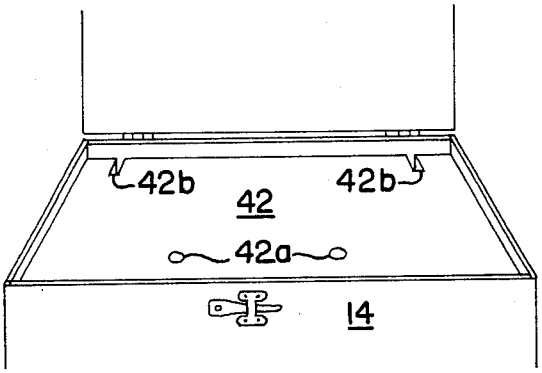
FIG. 2C is another detailed fragmentary perspective view of the canoe box with the box cover in open position showing an optional insulation cover panel in position.

As shown in FIGS. 2, 2A and 2B, the vertical square cross section posts or braces 36 are terminated below the top edges of the box panels in order to accommodate the table panel 25 when it is mounted in storage position on the undersurface of the box cover 12. Furthermore, the end insulation panels 46 are cut to a dimension so that the upper edge of the insulation panels 46 terminate a distance below the vertical posts or braces 36 so that a cover insulation panel may be fitted in the box if desired. Thus, as shown in FIG. 2C, a cover insulation panel 42 is fitted over the contents of the box resting on the upper edges of end insulation panels 36. The cover insulation panel 42 is provided with handle holds **42*a* for holding and placing the cover insulation panel 42 in position and for removing the panel. Cutouts 42*b* may also be provided to accommodate the top of the L brackets 26 on table panel 25 when the box cover 12** is closed with the table panel in stored position on the undersurface of the box cover.

Figure 3:
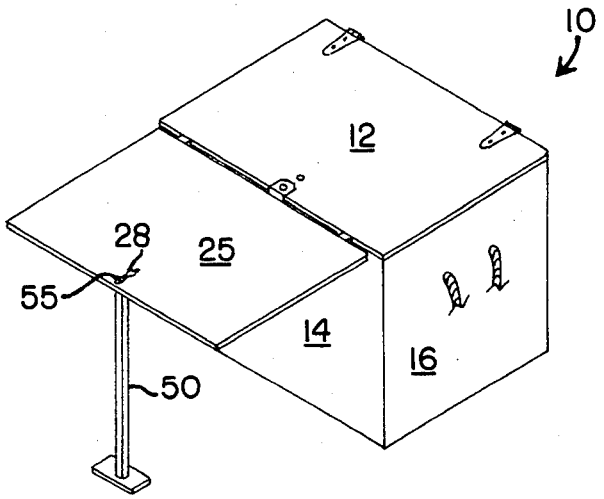
FIG. 3 is a perspective view of the canoe box with table panel in position for table use showing the table panel auxiliary support leg and with the box cover closed for table use also.

In FIG. 3 the table panel 25 is shown in position for table use secured to the side of the box after removal from storage position on the undersurface of the box cover 12. The table panel 25 is placed in table use position by inserting the ends of L brackets 26 into the slot brackets 48 secured adjacent to the upper edge at the front of side box panel 14 on the side of the box opposite the hinges 17. The slot brackets 48 may be constructed by bolting short lengths of, for example, brass flatbar over washers to the front of side box panel 14 leaving slots of just the right thickness to receive the extending portion of L brackets 26.

Figure 3A:
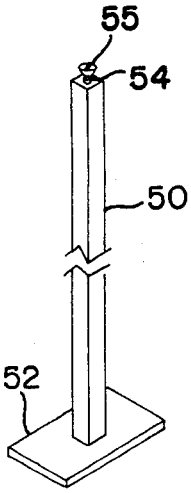
FIG. 3A is a detailed side view of the support leg.

To provide further support for bearing weight on table panel 25, an auxiliary support leg 50 is provided as shown in more detail in FIG. 3A. The support leg 50 may be stored in the box and includes a platform base 52 and a projecting bolt or screw 54 at the top with a head 55. The projecting bolt 54 and head 55 are sized to pass through the major opening of keyhole slot 28 formed in table panel 25. The bolt 54 is then slid into a narrow portion **28*a* of double slotted keyhole 28 so that the head 55 bears against the surface of table panel 25 holding the supporting leg 50** in position at the outer edge of the table panel.

Figure 4:
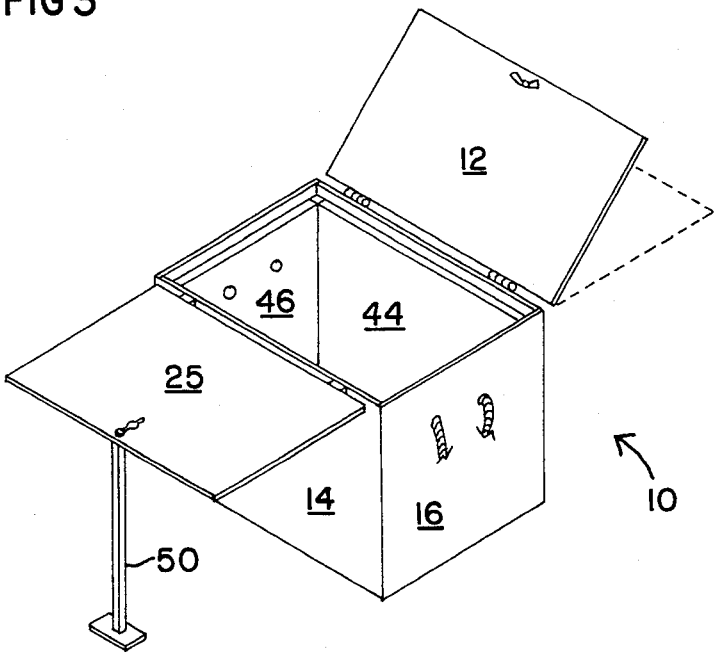
FIG. 4 is another perspective view of the canoe box with the table panel in position for table use but with the box cover open.

A feature and advantage of this arrangement is that heavyweight utensils such as, for example, a cook stove or lantern can be supported on the table panel. At the same time the box cover 12 may be placed in closed position over the box 10 providing an additional table surface adjoining the table panel 25 as shown in FIG. 3. Alternatively, as shown in FIG. 4, the box cover 12 may be placed at the same time in an open position for access to the contents inside box 10. As further shown in FIG. 4, the box cover 12 even in open position may be rested upon a convenient object to provide a supplementary table surface in the open position.

Overall, the box may be constructed, for example, of $\frac{1}{4}''$ plywood of a softwood composition full of natural pitch which may be coated with urethane or marine varnish thereby to withstand prolonged wet conditions. Even greater strength and protection from the elements can be provided by coating the box with an epoxy resin. As stated above, waterproof glue may also be used at abutting surfaces further to assure a watertight enclosure. With all of the cooperative features described above, the present invention provides a box with interacting elements particularly adapted and suited for the rigors and hazards of canoe travel. Fragile items are protected from rough travelling and are kept dry and safe. Food is maintained in fresh condition. Overall, the box and its contents are protected by a variety of safeguards in the event the canoe is swamped or capsized. In camping conditions the contents are safe from animals and insects and yet the box provides a variety of working surfaces for camping and table use, while at the same time permitting access to the contents of the box. While the invention has been described with reference to a particular preferred example embodiment, it is intended to cover all variations and equivalents within the scope of the following claims.

We claim:

1. A canoe travel box comprising:

an elongate box comprising a pair of elongate rectangular side box panels, an elongate rectangular bottom box panel, and a pair of end box panels adjoining said elongate side box panels and bottom box panel, said box panels secured at respective adjoining edges of the box panels by vertical and horizontal square section posts inside the box lying along and abutting the adjoining edges of the box panels, said posts defining between adjacent parallel posts flat spaces coplanar with each of said respective box panels for receiving insulation panels flush with said box panels;

a plurality of relatively rigid insulation panels comprised of waterproof flotation material, said insulation panels insertable between and frictionally engaging the posts defining at least some of the flat spaces flush with respective box panels;

a box cover hingedly coupled at one side to one of said side box panels for opening and closing through an arc of at least 180°, said box cover comprising cover latch means on the side opposite the hinged side for releasable closure engaging the other side box panel;

a table panel for providing a table surface for table use adjacent to said box, said table panel formed with L brackets on one side thereof, and one of the side box panels of said box formed with slot brackets for receiving the ends of said L brackets for rigidly securing the table panel to the upper edge of said side box panel with the table panel projecting away from the box during table use;

means for securing the table panel to the undersurface of said box cover for storage during canoe travel so that access to the inside of the box may be readily achieved during canoe travel by simultaneously opening the box cover and secured table panel without interference from the table panel, said means for securing the table panel to the undersurface of the box cover comprising retaining guide means secured to one side of the undersurface of the box cover for engaging one edge of the table panel, said table panel formed on the opposite side with a keyhole of variable width for receiving wing nut means through a wider portion but providing a bearing surface for said wing nut in a narrower portion, said box cover formed with a projecting bolt for passing through the keyhole whereby the table panel may be secured against the box cover by said wing nut means on the projecting bolt bearing against the undersurface of the table panel;

supporting leg means for supporting the outer edge of the table panel projecting away from the box when weight is bearing on said table panel during table use, said supporting leg means comprising projecting means at the end thereof for passing through the keyhole formed in the table panel and coupling the top of said leg support means to the underside of the table panel;

flexible loop handle means formed on each end box panel for carrying said canoe travel box, said flexible loop handle means formed with quick disconnect couplings for releasably opening and closing the handle loop means, said flexible handle loop means formed with sufficient length for securing said handle loop means over a strut of a canoe during canoe travel and for quickly releasing said handle loop means from the canoe;

said side box panel on the side of the cover latch means comprising complementary latch means including flexible thong means for flexibly engaging the cover latch means and for quick release for access to the box during canoe travel.

2. The canoe travel box of claim 1 wherein the vertical square section posts terminate below the top of the box panels to accommodate said table panel in stored position secured to the undersurface of the box cover.

3. The canoe travel box of claim 2 wherein is further provided a relatively rigid insulation cover panel, and wherein the box panel insulation panels comprise at least a pair of end insulation panels insertable between and frictionally engaging the posts defining flat spaces flush with the end box panels, said end insulation panels terminating below the top of the respective end box panels so that the insulation cover panel may be placed and rest upon the upper edges of said end insulation panels inside the box and below the box cover and stored table panel.

4. The canoe travel box of claim 3 wherein the insulation cover panel is formed with finger holes for placement and removal of the panel.

5. The canoe travel box of claim 1 wherein said quick disconnect couplings are centered at the end of the loop of the respective flexible loop handle means whereby said quick disconnect couplings provide hand grips at the ends of said loop handle means.

6. The canoe travel box of claim 4 wherein said quick disconnect couplings comprise elongate snap hooks.

7. The canoe travel box of claim 1 wherein said bottom box panel is formed with slides or runners for sliding the box and for raising the bottom of the box above the bottom surface of a canoe.

8. The canoe travel box of claim 1 wherein the supporting leg means is formed with a platform base.

9. The canoe travel box of claim 8 wherein said projecting means at the end of the supporting leg means comprises a projecting screw and screw head.

10. A canoe travel box comprising:

an elongate box comprising a pair of elongate rectangular side box panels, an elongate rectangular bottom box panel, and a pair of end box panels adjoining said elongate side box panels and bottom box panel, said box panels secured at respective adjoining edges of the box panels by vertical and horizontal square section posts inside the box lying along and abutting the adjoining edges of the box panels, said posts defining between adjacent parallel posts flat spaces coplanar with each of said respective box panels for receiving insulation panels flush with said box panels;

a plurality of relatively rigid insulation panels comprised of waterproof flotation material, said insulation panels insertable between and frictionally engaging the posts defining at least some of the flat spaces flush with respective box panels;

a box cover hingedly coupled at one side to one of said side box panels for opening and closing through an arc of at least 180°, said box cover comprising cover latch means on the side opposite the hinged side for releasable closure engaging the other side box panel;

a table panel for providing a table surface for table use adjacent to said box, said table panel formed with projecting brackets on one side thereof, and one of the side box panels of said box formed with receiving brackets for receiving the ends of said projecting brackets for rigidly securing the table panel to the upper edge of said side box panel with the table panel projecting away from the box during table use;

means for securing the table panel to the undersurface of said box cover for storage during canoe travel so that access to the inside of the box may be readily achieved during canoe travel by simultaneously opening the box cover and secured table panel without interference from the table panel, said means for securing the table panel to the undersurface of the box cover comprising retaining guide means secured to one side of the undersurface of the box cover for engaging one edge of the table panel, said table panel formed adjacent to the opposite edge with means for securing said table panel against the undersurface of the box cover;

supporting leg means for supporting the outer edge of the table panel projecting away from the box when weight is bearing on said table panel projecting away from the box when weight is bearing on said table panel during table use, said supporting leg means comprising coupling means at the end thereof for coupling the top of said supporting leg means to the underside of the table panel;

flexible loop handle means formed on each end box panel for carrying said canoe travel box, said flexible loop handle means formed with quick disconnect couplings for releasably opening and closing the handle loop means, said flexible handle loop means formed with sufficient length for securing said handle loop means over a strut of a canoe during canoe travel and for quickly releasing said handle loop means from the canoe;

said side box panel on the side of the cover latch means comprising complementary latch means releasably engaging the cover latch means for quick release for access to the box during canoe travel.

* * * * *